US006188360B1

(12) United States Patent
Kato et al.

(10) Patent No.: US 6,188,360 B1
(45) Date of Patent: Feb. 13, 2001

(54) RADIO-FREQUENCY RADIATION SOURCE, RADIO FREQUENCY RADIATION SOURCE ARRAY, ANTENNA MODULE, AND RADIO EQUIPMENT

(75) Inventors: Takatoshi Kato, Mino; Koichi Sakamoto, Otsu; Kenichi Iio, Nagaokakyo; Yohei Ishikawa, Kyoto, all of (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/389,856

(22) Filed: Sep. 2, 1999

(30) Foreign Application Priority Data

Sep. 4, 1998 (JP) ..... 10-250793

(51) Int. Cl.[7] ..... H01Q 3/02
(52) U.S. Cl. ..... 343/700 MS; 343/846
(58) Field of Search ..... 343/700 MS, 850, 343/852, 860, 718, 742, 770, 702, 741, 749, 846

(56) References Cited

U.S. PATENT DOCUMENTS 3,680,135 * 7/1972 Boyer ..... 343/742
5,105,200 * 4/1992 Koepf ..... 343/700 MS
5,202,697 * 4/1993 Bonebright et al. ..... 343/770
5,532,705 * 7/1996 Hama ..... 343/718
5,801,660 * 9/1998 Ohtsuka et al. ..... 343/700 MS

* cited by examiner

*Primary Examiner*—Don Wong
*Assistant Examiner*—Chuc D Tran
(74) *Attorney, Agent, or Firm*—Ostrolenk, Faber, Gerb & Soffen, LLP

(57) ABSTRACT

A radio-frequency radiation source comprises electrodes containing opposing electrodeless parts formed on both sides of a dielectric plate in which the electrodeless parts are made to function as a dielectric resonator, a slit formed in the electrodeless part, and a switching element mounted over the slit. Further, a transmission line coupled to the dielectric resonator is provided. As constructed this way, the resonance frequency of the resonator is switched by turn-on and turn-off of the switching element. When the resonator resonates with the frequency of a signal propagated through the transmission line, the energy of the electromagnetic field is radiated to the outside through a slot.

31 Claims, 12 Drawing Sheets

HE 110 MODE

TE 010 MODE

RADIO-FREQUENCY RADIATION SOURCE, RADIO FREQUENCY RADIATION SOURCE ARRAY, ANTENNA MODULE, AND RADIO EQUIPMENT

BACKGROUND OF THE INVENTION

1. Field of the Invention

The present invention relates to a radio-frequency radiation source, radio-frequency radiation source array, antenna module, and radio equipment to be used in radio-frequency bands of a millimeter wave region, and so on.

2. Description of the Related Art

In a radio-frequency antenna, when a circuit to turn on and off an electromagnetic wave to be output from the radiation source is constructed, heretofore a switch is provided between an element or a conductor pattern to be used as a radiation source and a feed system. The example is shown in FIG. 15. FIG. 15A is an equivalent circuit diagram and FIG. 15B is a perspective view showing the construction of a radio-frequency circuit portion. In this way, a diode D1 is provided in series to a feed circuit of a square patch antenna, and a series circuit of a diode D2 and a resistor R is provided between the feed circuit and ground.

The above circuit constitutes a so-called SPST (Single Pole Single Throw) radio-frequency switch and is to switch on and off radiation of an electromagnetic wave by switching on and off the power to the radiation source.

In such a system, because the loss in the switch(diode) is great, there is a problem in that the antenna gain and efficiency are reduced and the antenna noise is increased. Further, because the radiation source and the switch are constructed using different circuits, there is a problem in that the circuits'construction becomes complicated. For example, as shown in FIG. 15, when the power is not supplied to the radiation source, the resistor R is provided so that the impedance looking at the side of the radiation source from the input terminal is constant, and accordingly a circuit construction in which power is consumed at the resistor is required. Therefore, at least two diodes are required, and a circuit (DC biasing circuit) applying controlling voltages to these diodes becomes complicated. FIG. 16 shows an example. In the figure, C1, C2, and C3 are capacitors to block DC currents, and L1, L2, and L3 acts as a choke to radio frequencies and are inductors to supply DC biasing voltages to diodes D1 and D2.

SUMMARY OF THE INVENTION

According to the present invention, a radio-frequency radiation source in which the loss in the switch is greatly reduced, the complication of the circuit construction is solved, and the electromagnetic radiation can be switched on and off, and a radio-frequency radiation source array, antenna module, and radio equipment using such are provided.

In order to solve the above problems, in the present invention, a radio-frequency radiation source comprises a switching element or a variable reactance element, a resonator in which a resonance frequency is changed by turning on or off the switching element or by switching the reactance of the variable reactance element, a radiation means to radiate to the outside an electromagnetic energy of a fixed frequency stored in the resonator, and a transmission line coupled to the resonator.

In this way, the resonance frequency of the resonator is changed by turning on and off the switching element or by switching the reactance of the variable reactance element. When the frequency of a signal to be supplied to the resonator through the transmission line coincides with the resonance frequency of the resonator, the electromagnetic field is confined in the resonator and radiated as an electromagnetic wave to the outside, but when the resonance frequency of the resonator does not coincide with the frequency of the signal supplied through the transmission line, the resonator does not resonate and an electromagnetic wave is not radiated. In like manner, when the resonance frequency of the resonator coincides with the frequency of an electromagnetic wave incident from the outside, the electromagnetic field is confined in the resonator and the reception signal is radiated, and when the resonance frequency of the resonator does not coincide with the frequency of the electromagnetic wave incident from the outside, the resonator doe not resonate and the signal is not transmitted through the transmission line.

Thus, a radiation source and switch are not constructed as separate circuits, but a switching function is included in the radiation source itself. Because of this, a loss in the switch is not caused. That is, in a condition in which the resonator does not resonate, it is as if there was no resonator itself and the loss becomes almost zero. Further, even if the resonator resonates, because any loss but the loss caused by the Q of the resonator itself is not brought about, a low-loss radiation loss can be realized. Further, because the switch and radiation source are not required to be made separate circuits, the circuit construction is greatly simplified. Particularly, it is not required to provide any switching element and biasing circuit to the switching element on the feed line, and the total circuit construction is greatly simplified.

In the present invention, the resonator comprises electrodes having opposing electrodeless parts formed on both surfaces of a dielectric plate, a slit formed in a section of the electrodeless part at least on one surface of the dielectric plate, and the switching element or the variable reactance element provided across the slit. As constructed this way, because the electrodeless parts act as a dielectric resonator and the electromagnetic field distribution in the slit portion of the electrodeless parts is changed by turning on and off the switching element or by switching the reactance of the variable reactance element, in accordance with the change the resonance frequency can be largely changed.

Further, in the present invention, a dielectric resonator is placed and held in an electrodeless part on the dielectric plate. As constructed this way, even if the dielectric constant of the dielectric plate is relatively high, the radiation efficiency of an electromagnetic wave can be increased.

Further, in the present invention, a secondary line different from a transmission line to be coupled to the resonator is provided, and the switching element or the variable reactance element is connected to the secondary line. As constructed this way, the resonance frequency of the resonator can be changed by turning on and off the switching element or by switching the reactance of the variable reactance element.

Further, in the present invention, a radio-frequency radiation array comprises a plurality of the radio-frequency radiation sources, wherein one end of the transmission lines of these radio-frequency radiation sources is connected in parallel with each other. Further, a radio-frequency radiation array comprises the connected-in-series transmission lines of the radio-frequency radiation sources, one end portion of which is terminated. As constructed this way, the radio-frequency radiation array can be used as an array antenna having a transmission line and a plurality of radiation sources.

Further, in the present invention, an antenna module comprises a dielectric lens in which the location of each of the radio-frequency radiation sources of the above radio-frequency radiation source array constitutes nearly a focusing surface. According to this construction, by making a plurality of radio-frequency radiation sources selectively activated, the direction of a beam to be determined by the relative positional relationship between the radio-frequency radiation sources and the dielectric lens can be changed.

Further, in the present invention, a radio equipment comprises a transmission circuit or reception circuit connected to a transmission line of the radio-frequency radiation source, radio-frequency radiation source array, or antenna module.

BRIEF DESCRIPTION OF THE DRAWING(S)

DETAILED DESCRIPTION OF EMBODIMENTS OF THE INVENTION

The construction of a radio-frequency radiation source according to a first embodiment is explained with reference to FIGS. 1 through 4.

Figure 1:
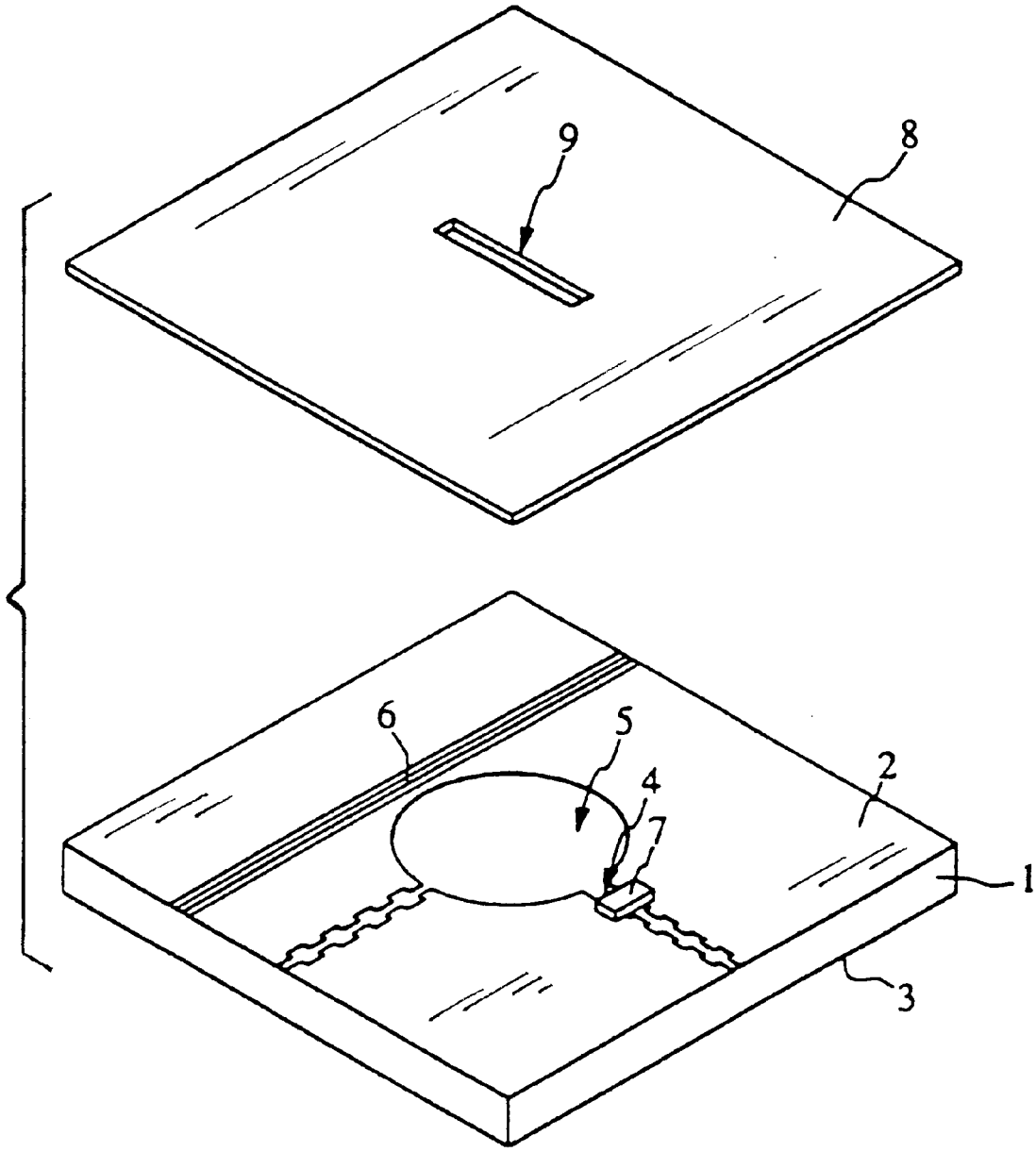
FIG. 1 is a perspective view showing the construction of a radio-frequency radiation source.

FIG. 1 is a perspective view of a radio-frequency radiation source. Here, reference numeral 1 represents a dielectric plate and on the upper and lower surfaces in the figure electrodes 2 and 3 are formed. In these electrodes 2 and 3, electrodeless parts are formed at opposing locations to sandwich the dielectric plate 1. The electrodeless parts are in a radial form, but they can be appropriately modified in accordance with their purposes. In the present embodiment circular electrodeless parts are preferable in order to realize a high Q. Further, although the external shape of opposing electrodeless parts are desirable to be nearly in agreement, they may not be. Reference numeral 5 represents an electrodeless part on the upper surface in the figure. In a section of the upper surface 5 a slit having a fixed width and fixed length is formed and a switching element 7 is mounted across the slit. In the electrode 2 on the upper surface, for example, a coplanar line 6 passing through the vicinity of the electrodeless part 5 is formed. Here, the dielectric plate portion sandwiched by the upper and lower electrodeless parts is used as an HE10 mode dielectric resonator. In the upper portion of the resonator in the figure a slot plate 8 having a slot 9 formed thereon is arranged. Although a slot was formed in the present embodiment, any opening suffices if a fixed radiation pattern of an electromagnetic wave can be obtained. The slot 9 is provided in the direction along the magnetic field of the electromagnetic field to be confined around the resonator. As constructed this way, an electric potential difference is produced on both sides of the slot and an electromagnetic wave is radiated from the slot.

Figure 2A:
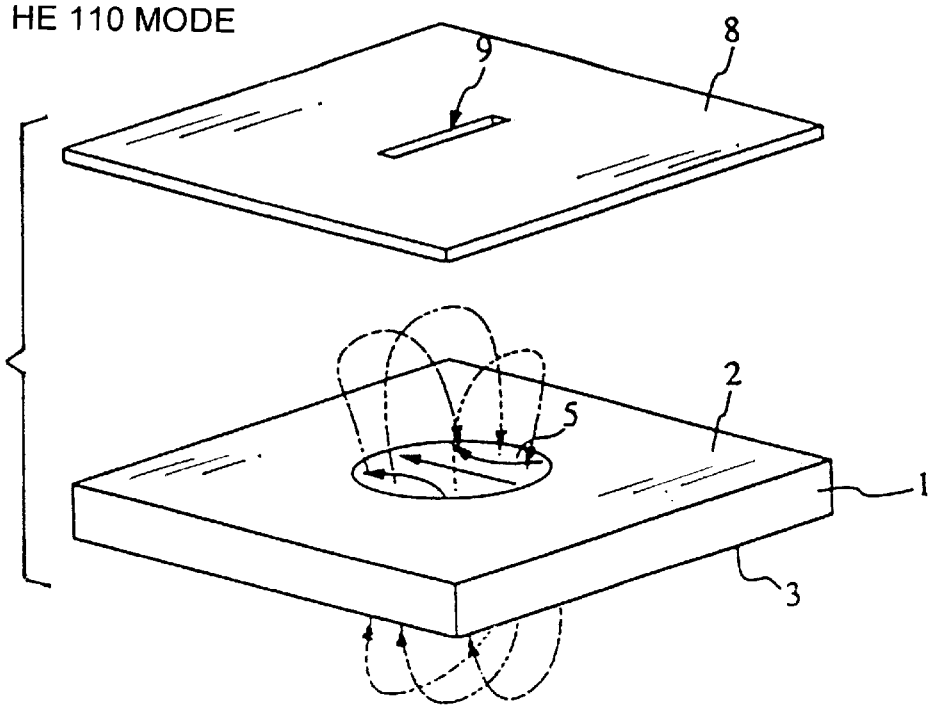
FIG. 2 shows an example of the positional relationship between the distribution of an electromagnetic field generated in a resonator and a slot.
Figure 2B:
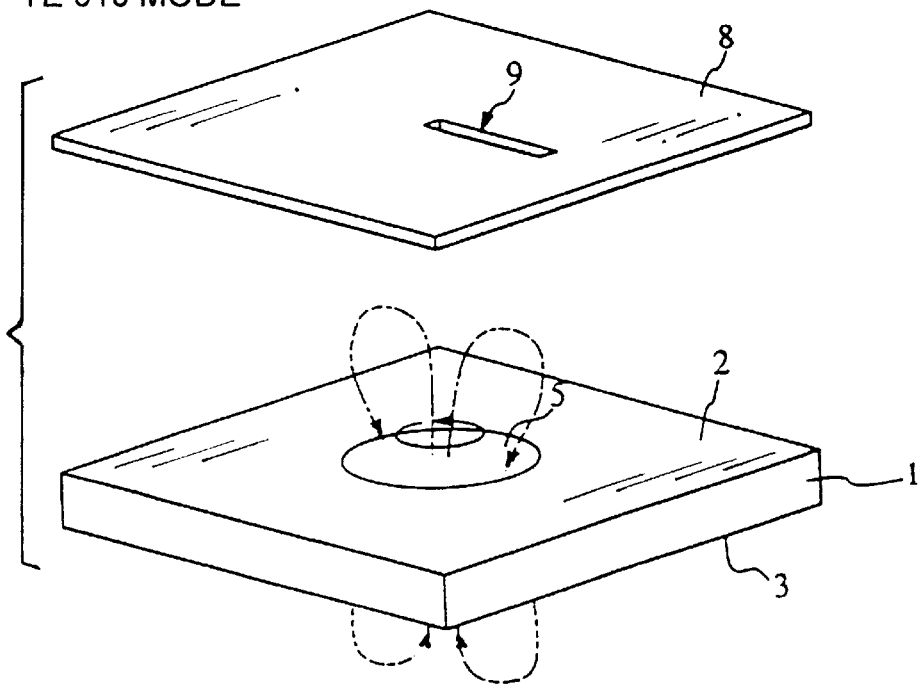

FIG. 2 shows an example of the positional relationship between the distribution of an electromagnetic field generated in the resonator and the slot. In FIG. 2, the solid line is the line of electric force showing the distribution of electric field and the broken line is the line of magnetic force showing the distribution of magnetic field. In the HE110 mode, an electromagnetic field as shown in FIG. 2A is generated and the field is confined in the vicinity of the resonator. A slot 9 runs across the electric field in the upper part of the resonator and is arranged in the direction along the magnetic field. Therefore, an electric potential difference is produced on both sides of the slot 9, and an electromagnetic field is radiated outside from the slot. In the TE010 mode, as shown in FIG. 2B, a slot is also arranged so as to run across the electric field in the upper part of the resonator and in the direction along the magnetic field. The same thing can be said about other modes, and in accordance with resonance modes to be used, the slot has only to be arranged so as to run across the electric field produced around the resonator and in the direction along the magnetic field.

Figure 3:
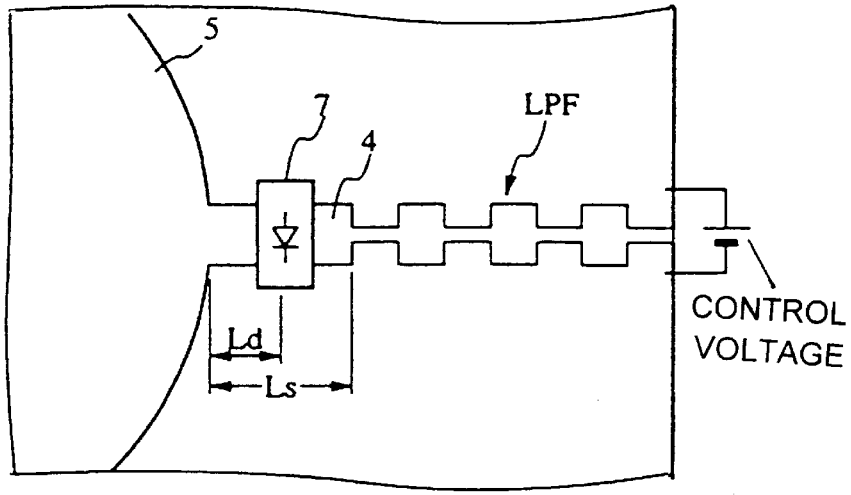
FIG. 3 shows the construction of a slit portion of a radio-frequency radiation source.

FIG. 3 is a top view showing the construction of the slit portion. For high frequencies the slit has a fixed width and a length of Ls, but in order to apply a direct-current control voltage to the switching element 7 being over the slit 4 and connected to the electrodes, the electrodes on both sides of the slit 4 are separated for direct current to the end portion of the dielectric plate. At another location in the electrodeless part 5, a place in which the electrode 2 on the upper surface of the dielectric plate is separated for direct current is provided as shown in FIG. 1. It is made to apply a control voltage between these two electrodes. Moreover, between the portion in which the control voltage is applied and the slit 4, an area having a narrow spacing between the electrodes and an area having a wide spacing between the electrodes are alternately arranged to constitute a low-pass filter. In this way, the length of the slit 4 is made Ls for high frequencies, and high-frequency signals are made not to leak out into the circuit portion to apply the control voltage.

Figure 4:
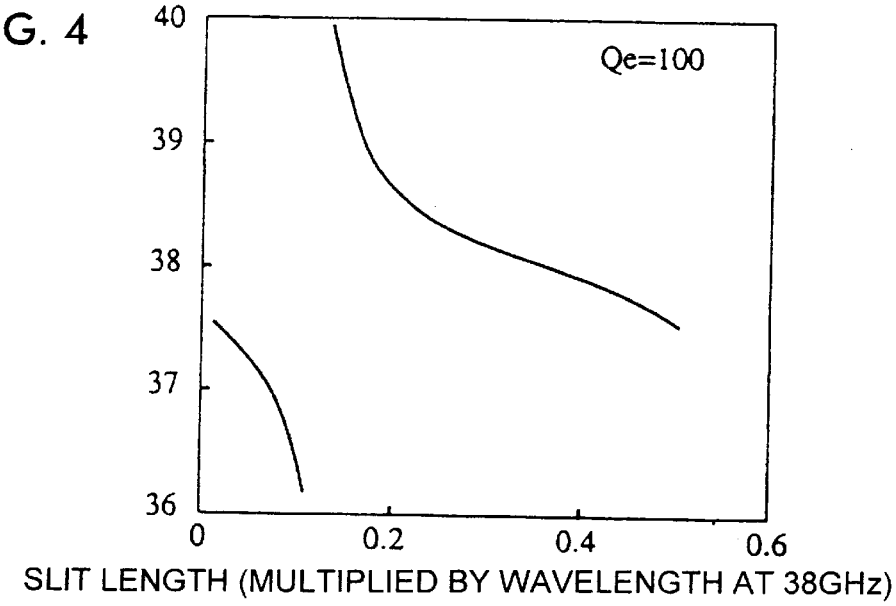
FIG. 4 shows the relationship between the slit length of a slit portion of a radio-frequency radiation source and the resonance frequency.

FIG. 4 shows the relationship between the length of a slit given in an electrodeless part constituting a resonator and the resonance frequency of the resonator. In this example, if the slit length (Ls shown in FIG. 3) is zero, that is, if there is no slit, the resonance frequency of the resonator is 37.5 GHz, and when the slit length is lengthened, the resonance frequency is lowered. For example, if one wavelength is represented by 1, when the slit length is 0.11, the resonance frequency becomes 36 GHz. If the slit length is further lengthened to 0.151, the resonance frequency becomes 40 GHz. Then, if the slit is further lengthened, the resonance frequency is decreased, and for example, the resonance frequency becomes 38 GHz at 0.31. The reason why the change of the resonance frequency is not continuous is that the resonance mode of the resonance circuit system made up of a resonator and a slit is changed.

The slit length Ls and installation position Ld of the switching element 7 are determined looking at the discontinuity of the change of resonance frequencies in accordance with the change of the above slit length. For example, under the condition that the slit length Ls is made 0.151 and the installation position Ld is made 0.11, when the switching element 7 is turned off it is equivalent to a condition in which there is no switching element and accordingly the resonance frequency becomes 40 GHz, and when the switching element 7 is turned on it is equivalent to a condition in which the slit length is 0.11 and accordingly the resonance frequency becomes 36 GHz. Therefore, by turning on and off the switching element in this case the difference of 4 GHz in resonance frequencies can be obtained. Further, for example, if the slit length is made 0.31 and the switching element 7 is provided at the position of 0.01, that is, at the base position of the slit, a difference of about 500 MHZ in resonance frequencies can be obtained by turning on and off the switching element.

Next, examples using other switching elements are explained with reference to FIGS. 5 through 7.

Figure 5:
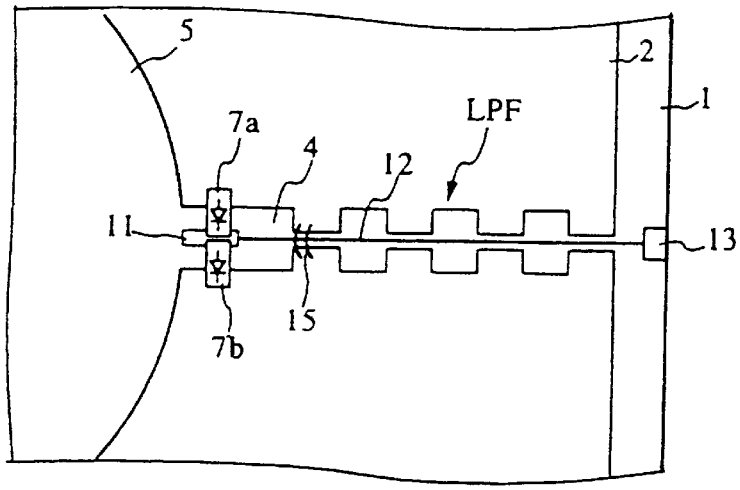
FIG. 5 shows the construction of a slit portion of another radio-frequency radiation source.

FIG. 5 is a top view of a slit portion. Different from the example shown in FIG. 3, a terminal 11 for setting up a diode in the central position of a slit 4 is formed, a terminal 13 for applying a control voltage is provided at the end portion of the dielectric plate 1, and further both of the terminals are connected by a central conductor 12. Between the terminal 11 and the terminals on both sides of the slit 4 diodes 7*a* and 7*b* forming a switching element are mounted. Therefore, by applying a control voltage between the terminal 13 for applying a control voltage and an electrode 2 on the upper surface as an earth electrode, the diodes 7*a* and 7*b* are turned on and off. When constructed this way, the electrodes on both sides of the slit 4 are not required to be separated for direct current. Moreover, between the slit 4 and the terminal 13 for applying a control voltage an area having a narrow spacing between the electrodes and an area having a wide spacing between the electrodes are alternately arranged to constitute a low-pass filter. Further, in the vicinity of the end portion of the slit 4, a wiring 15 for short-circuiting the electrodes is provided. By such a construction, the end portion of the slit 4 is surely short-circuited for high frequencies.

Figure 6:
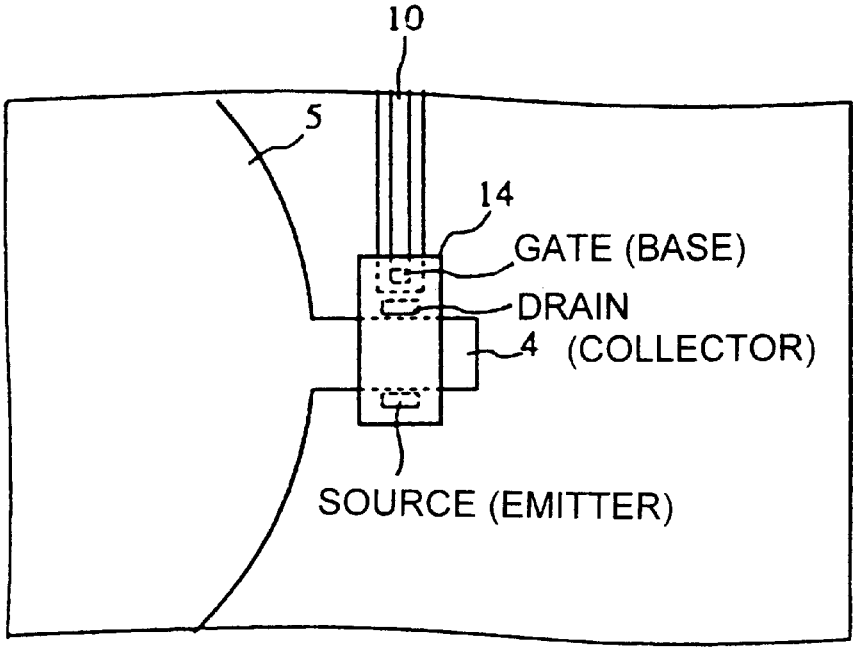
FIG. 6 shows the construction of a slit portion of a radio-frequency radiation source using an FET as a switching element.

FIG. 6 shows an example using an FET as a switching element. A control signal line 10 is provided in the vicinity of a slit 4, the drain and source of an FET 14 are connected to the electrodes over the slit 4, and the gate is connected to the end portion of the control signal line 10. As constructed this way, by applying a control voltage between the control signal line 10 and the earth potential (source potential) the FET is made to turn on and off. Moreover, in the case using a bipolar transistor, the same thing can be said, and it is only required that the collector and emitter of the transistor be connected over the slit 4 and the base be connected to the end portion of the control signal line 10.

Moreover, as the above examples show, a switching element has been mounted over the slit in the electrodeless part, but a variable reactance element having a reactance changed in accordance with a control voltage like a variable capacitance diode (varactor diode) may be mounted in the above slit portion. In that case, because the reactance is changed in accordance with the control voltage, the resonance frequency of the resonator changes.

Figure 7:
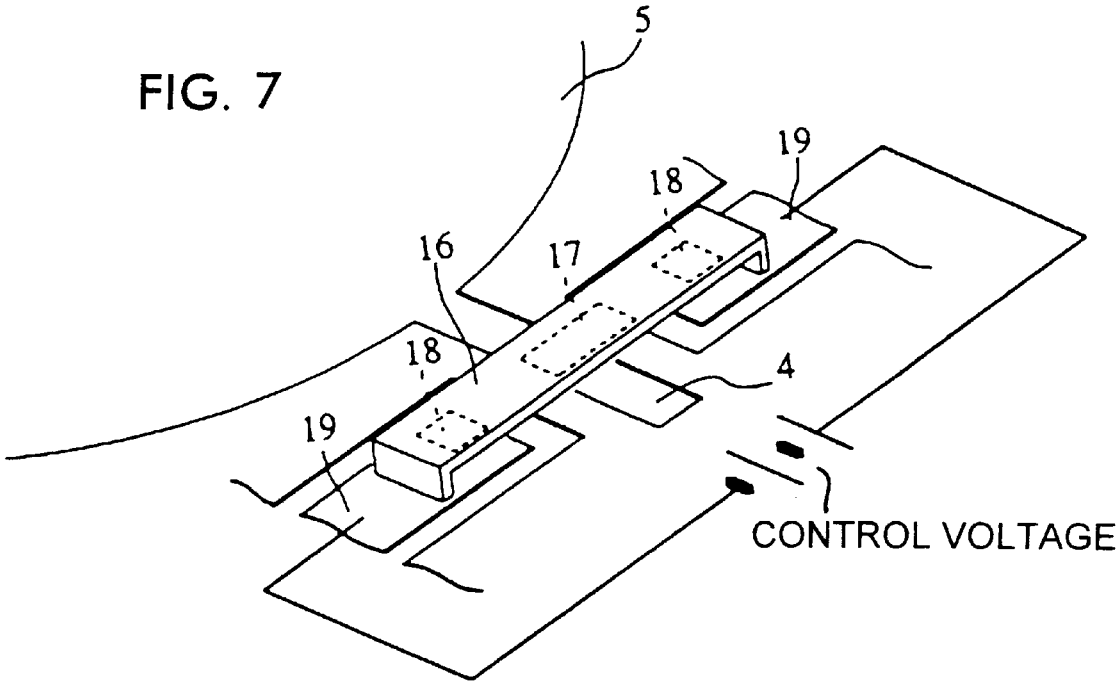
FIG. 7 is a perspective view showing the construction of a slit portion of a radio-frequency radiation source using a microswitch as a switching element.

FIG. 7 shows an example using a so-called microswitch. On the lower surface (surface opposite to the dielectric plate) of the support of a microswitch 16, an RF electrode 17 and control electrodes 18 and 18 are formed. Between these two control electrodes 18 and 18 direct current is conducted, but these electrodes are isolated from the RF electrode 17. On the dielectric plate control terminals 19 and 19 are formed on both sides of a slit 4, the control electrodes 18 and 18 of the microswitch are opposed to the control terminals 19 and 19, and the RF electrode 17 of the microswitch is arranged so as to be opposed to the slit 4. As constructed this way, by applying a direct-current control voltage to the control terminals 19 and 19, the end portions of the control terminals 19 and 19 and the control electrodes 18 and 18 are attracted because of a Coulomb force, and the spacing between the RF electrode 17 and the slit 4 is reduced. When the RF electrode 17 and the slit 4 come the closest, the RF electrode 17 is to short-circuit the electrodes on both sides of the slit 4. Therefore, by making use of the control voltage, it is possible to turn on and off a fixed position of the slit 4 or to change the capacitance between the electrodes on both sides at a fixed position of the slit 4 even if the fixed position of the slit 4 is not completely turned on and off. Accordingly, it is possible to change the resonance frequency of the dielectric resonator of the electrodeless part 5.

Figure 8:
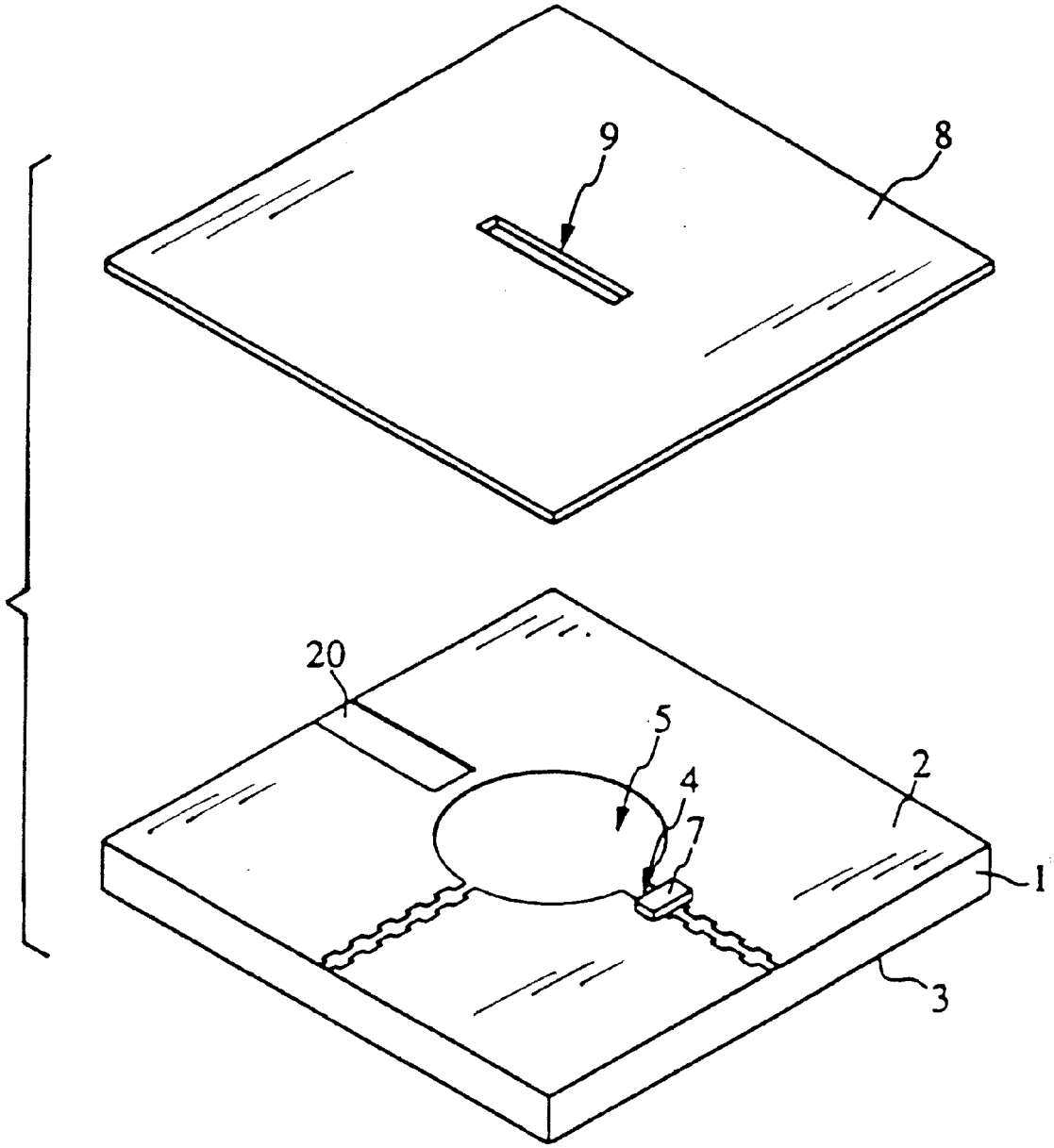
FIG. 8 is a perspective view showing the construction of a radio-frequency radiation source using a planar dielectric line as a transmission line.

Next, the construction of a radio-frequency radiation source using another transmission line is shown in FIG. 8. In the example shown in FIG. 1, a coplanar line as a transmission line was used, but in the example in FIG. 8 a planar dielectric transmission line (hereinafter, called PDTL line) 20 is used as a transmission line. The PDTL line comprises slots formed so as to be opposite to the electrodes 2 and 3 on the upper and lower surfaces of a dielectric plate 1, respectively, and this PDTL line itself is a patent applied for in Japanese Patent Application No. 7-6967. The center line of the PDTL line 20 is arranged so as to point to the center of an electrodeless part 5, and an electromagnetic wave propagated in the PDTL line and a dielectric resonator of the electrodeless part 5 are magnetically coupled.

Moreover, as another transmission line, by forming a slot only on one surface of the dielectric plate in the same way as in FIG. 8 a grounded slot line may be constructed.

Figure 9:
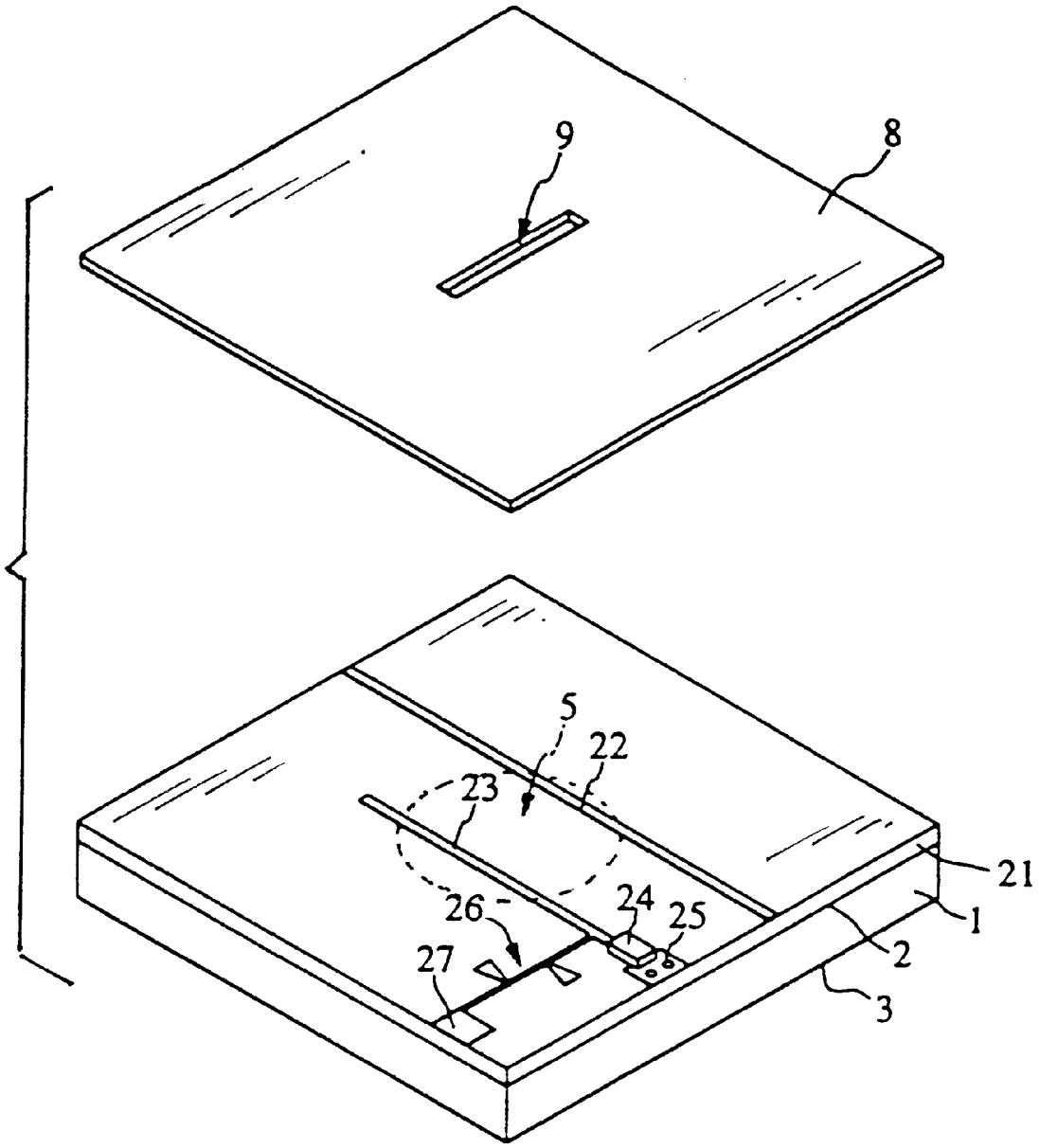
FIG. 9 is a perspective view showing the construction of another radio-frequency radiation source using a secondary transmission line.

Next, an example of the construction of another radio-frequency radiation source is explained based on FIG. 9. In FIG. 9, reference numeral I represents a dielectric plate, and electrodes 2 and 3 are formed on the upper and lower surfaces of the dielectric plate and circular electrodeless parts opposite to the electrodes 2 and 3 are provided to constitute a dielectric resonator in that portion. The construction is similar to that shown in FIG. 1, and so on. However, a slit is not formed to change the resonance frequency. Reference numeral 21 represents a microstrip substrate on the upper surface of which a microstrip line 22 as a transmission line and a microstrip line 23 as a secondary line for switching the resonance frequencies are formed. In the vicinity of the end portion of the microstrip line 23, an earth terminal 25 connected to an earth electrode on the lower surface (surface opposite to the upper surface of the dielectric plate 1) by a through-hole is formed, and a varactor diode 24 as a variable reactance element is mounted between the earth terminal 25 and the end portion of the microstrip line 23. On the upper surface of the microstrip substrate 21, a terminal 27 for applying a control voltage and a low-pass filter 26 connecting the terminal 27 and the microstrip line 23 are also formed.

The above two microstrip lines 22 and 23 are magnetically coupled with the dielectric resonator disposed in the portion of the electrodeless part 5 of the dielectric plate 1. As the capacitance of the varactor diode 24 is changed by a control voltage applied to the terminal 27, the loaded capacitance of the dielectric resonator is changed and the resonance frequency is changed. When the frequency of a signal propagated through the microstrip line 22 as a transmission line is equal to the resonance frequency of the resonator, an electromagnetic field is confined around the resonator and an electromagnetic wave is radiated through a slot 9 of a slot plate 8. When the resonance frequency of the resonator is not equal to the frequency of the signal propagated through the microstrip line 22, the resonator does not resonate and no electromagnetic wave is radiated. Further, on the contrary, when the frequency of an incident electromagnetic wave from the outside through the slot 9 is equal to the resonance frequency of the resonator, the resonator resonates with the electromagnetic wave and the reception signal is propagated through the microstrip line 22 in the microstrip line mode. When the resonance frequency of the resonator is not equal to the frequency of the incident electromagnetic wave, the resonator does not resonate with the electromagnetic wave and no reception signal is propagated through the microstrip line.

Moreover, instead of the varactor diode 24 shown in FIG. 9, a diode as a switching element may be mounted. In this case, because the reactance component is changed in accordance with the turn-on and turn-off of the switching element, the resonance frequency of the resonator is changed.

Figure 10:
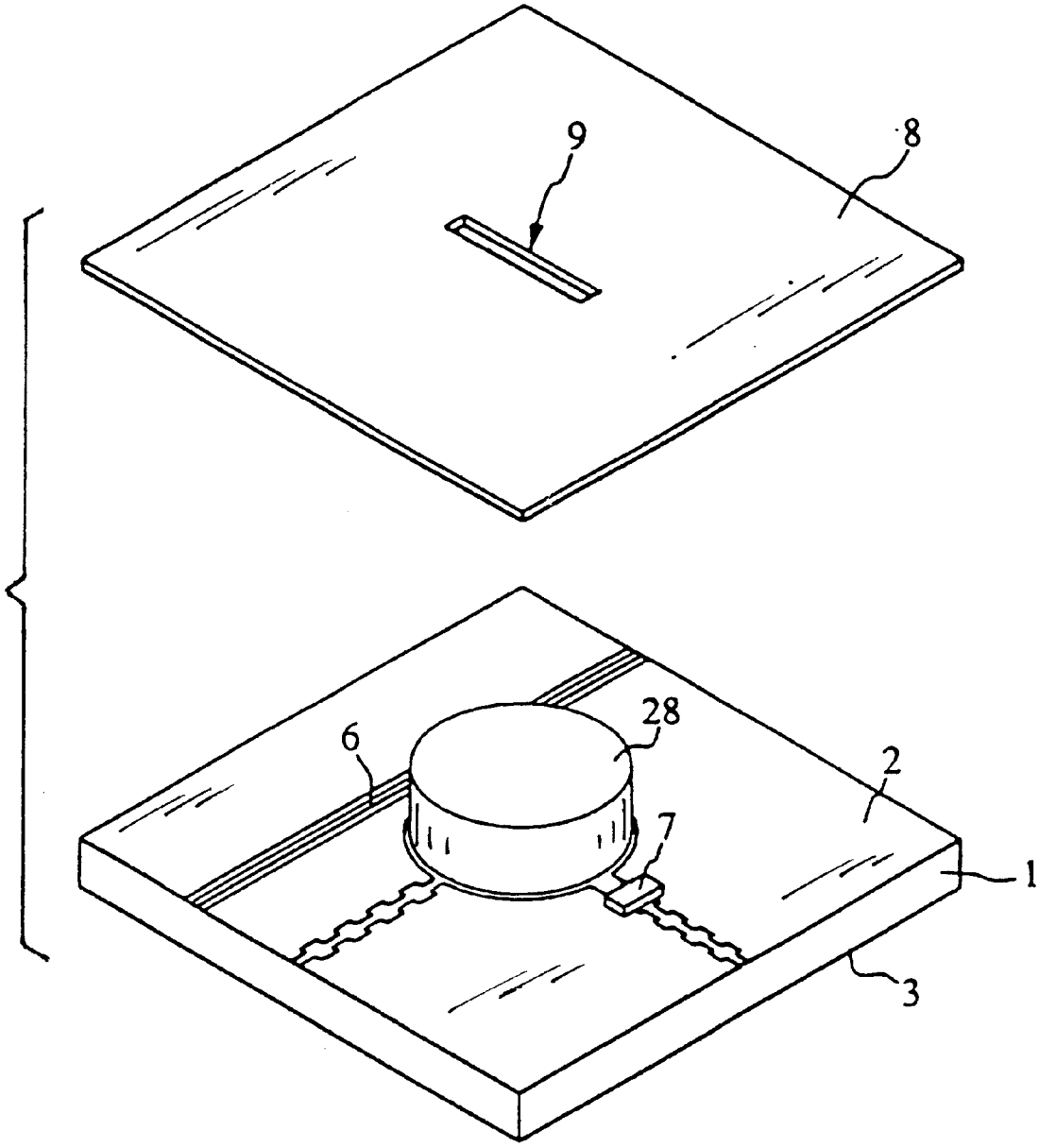
FIG. 10 is a perspective view showing the construction of another radio-frequency radiation source using a single dielectric resonator.

Next, the construction of another radio-frequency radiation source is shown in FIG. 10. In the example in FIG. 1, the electrodeless parts themselves of the dielectric plate were used as a dielectric resonator, but in these electrodeless parts a dielectric resonator 28 may be placed and held as shown in FIG. 10. In this example, the electrodeless parts of the dielectric plate are used as a resonator of the TE010 mode, and the cylindrical dielectric resonator is used as a resonator of the TE010d mode. When constructed this way, by making the dielectric constant of the dielectric resonator 28 smaller than that of the dielectric plate 1, the radiation efficiency of an electromagnetic wave can be heightened.

Next, examples of the construction of a radio-frequency radiation source array are explained with reference to FIGS. 11 and 12.

Figure 11A:
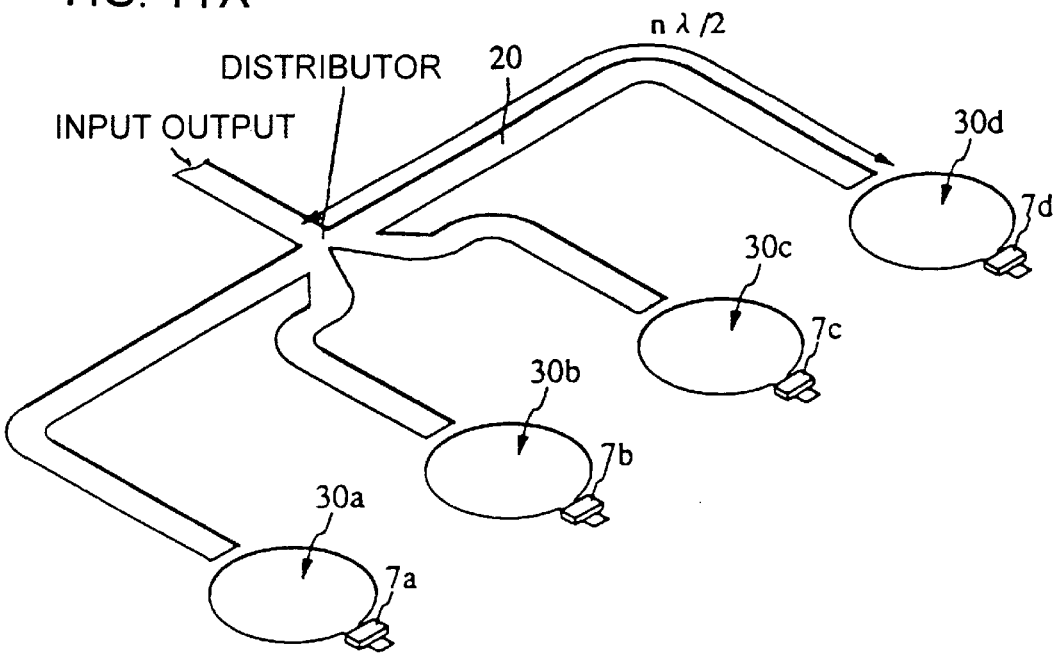
FIG. 11 is a perspective view showing the construction of a radio-frequency radiation source array.

FIG. 11 is a perspective view of a portion in which a plurality of radio-frequency radiation sources are arranged, and 30*a* through 30*d* represent the same radio-frequency radiation sources as that in FIG. 8, respectively. In the example shown in FIG. 11 A, a PDTL line 20 is branched off from a distributor portion and the end portion of each of the branches is coupled with the resonator of radio-frequency radiation sources indicated by 30*a* through 30*d*. A plurality of radiation sources are arranged this way, and the resonator of any one of the radiation sources is made to resonate with an input output signal and the other resonators are made not to resonate with the input output signal, and accordingly an electromagnetic wave is radiated only from the radiation source in a resonant state and the radiation source resonates with an incident electromagnetic wave. In this case, because the other resonators do not resonate, they are equivalent to non existence, and they can be considered to be only a short stub.

The line length to each of the radio-frequency radiation sources from the distributor portion is set to be nl/2. Here, l represents a wavelength, and n is an integer of one or more. When the line length to the radio-frequency radiation sources from the distributor portion is assumed to be an even multiple of l/4 this way, the branches in which the resonators do not resonate become equivalently short-circuited when looked at from the branch point of the line and the loss of the branches is suppressed. Also when a plurality of radiation sources are arranged this way, no switch is inserted in the way of each of the lines, and accordingly the gain and efficiency of the radiation sources are not lowered by the loss of the switch and the loss of the lines is caused only by the loss of the transmission lines.

Figure 11B:
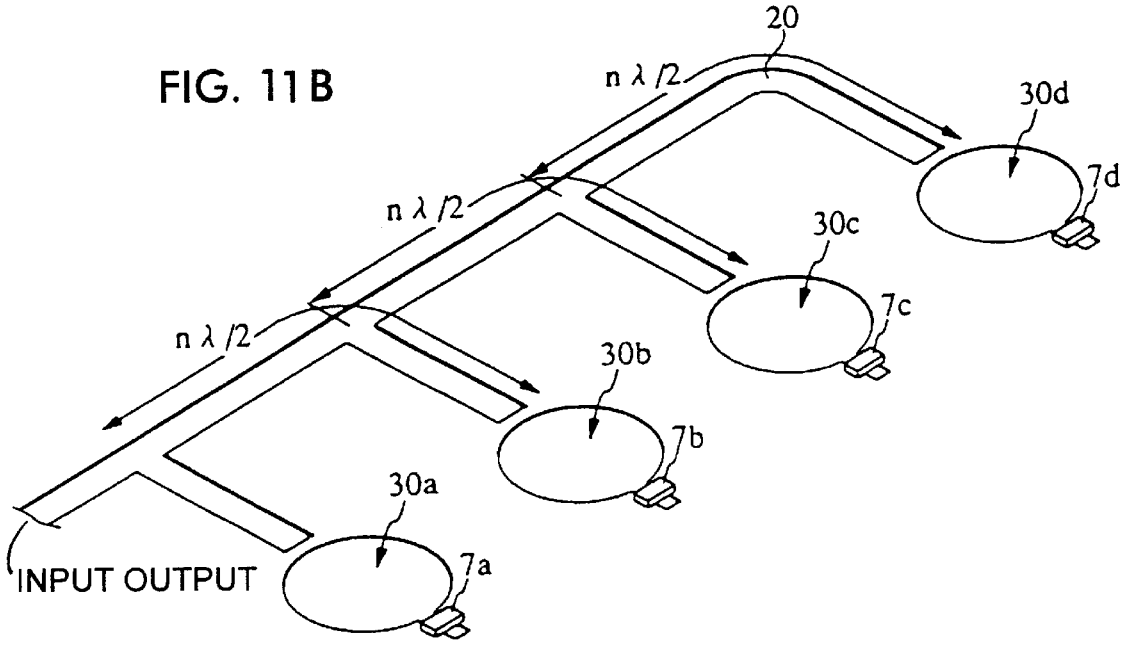

In the example shown in FIG. 11B, a PDTL line 23 is branched off at a plurality of locations and radiation sources 30*a* through 30*d* are arranged at the tip portion of each of the branches. In this case, the line length to each radiation source from each branch point is also made to be an even multiple of l/4.

Moreover, the transmission line of a radio-frequency radiation source array is not limited to a PDTL line, but may be a slot line, or a microstrip line.

Figure 12:
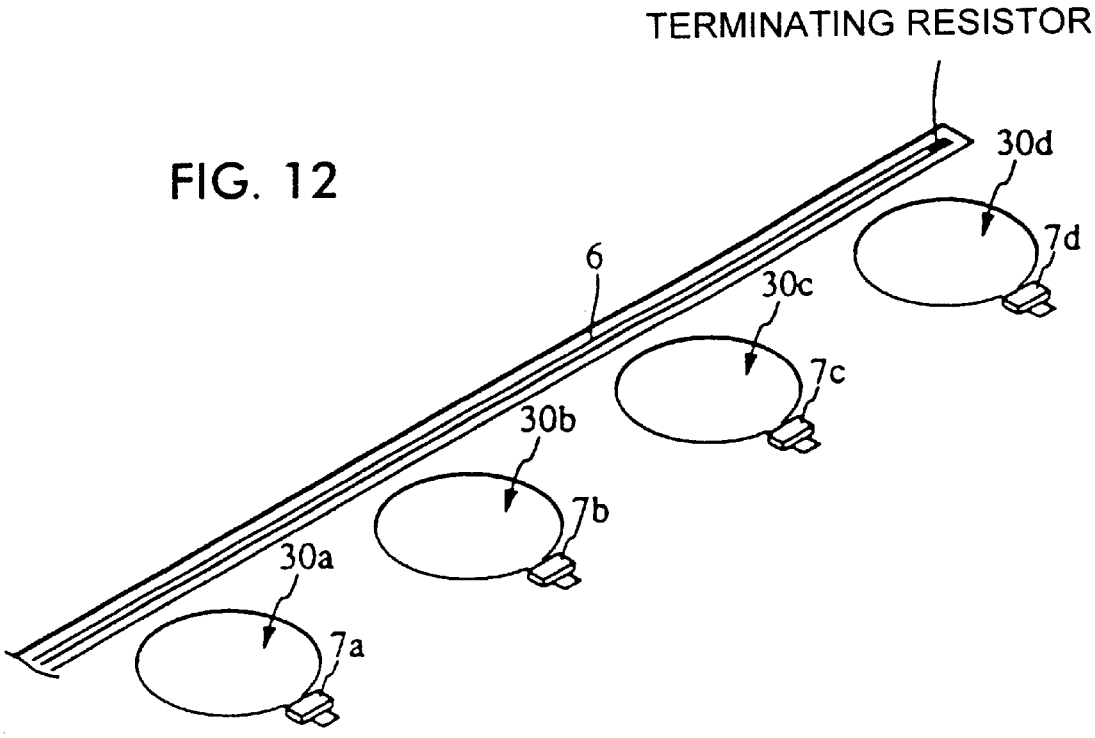
FIG. 12 is a perspective view showing the construction of another radio-frequency radiation source array.

In an example shown in FIG. 12, a coplanar line 6 as a transmission line is used, and this line is arranged in the direction of the arrangement of radio-frequency radiation sources 30*a* through 30*d*. The dielectric resonator of each of the radio-frequency radiation sources is magnetically coupled to the coplanar line 6. When the resonance frequency of a resonator is equal to the frequency of a signal propagated through the coplanar line 6, the resonator resonates and has an electromagnetic wave radiated. When the resonance frequency of a resonator is not equal to the frequency of the signal propagated through the coplanar line 6, the resonator is equivalent to nonexistence. Therefore, if the resonator of one radiation source among a plurality of radio-frequency radiation sources is made to resonate with the frequency of a signal propagated through the coplanar line 6, the spacing between the radio-frequency radiation sources 30*a* through 30*d* can be arbitrarily determined. Moreover, a terminating resistor is provided on the coplanar line 6 to suppress a standing wave.

Figure 13:
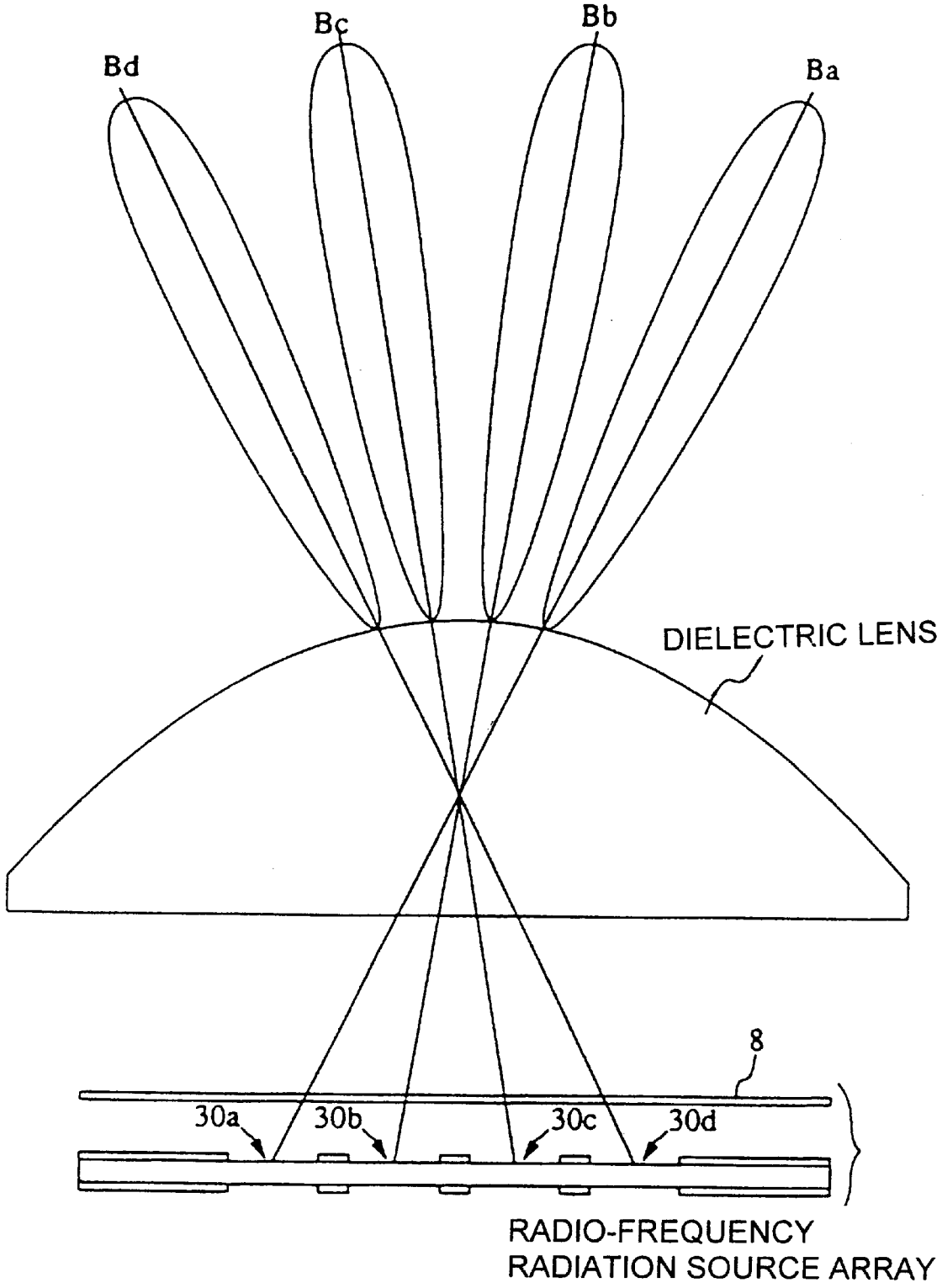
FIG. 13 shows the construction of an antenna module.
Figure 15A:
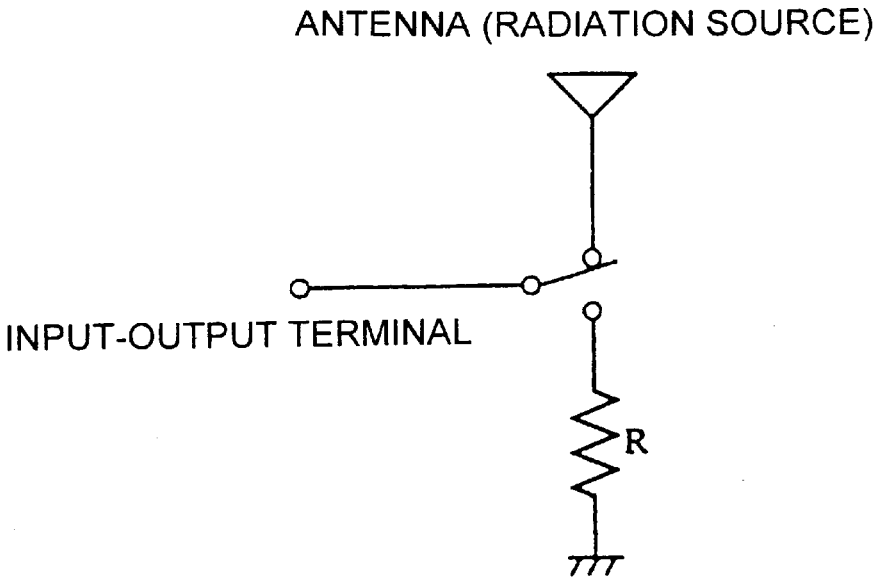
FIG. 15 shows the construction of a conventional radio-frequency radiation source.
Figure 15B:
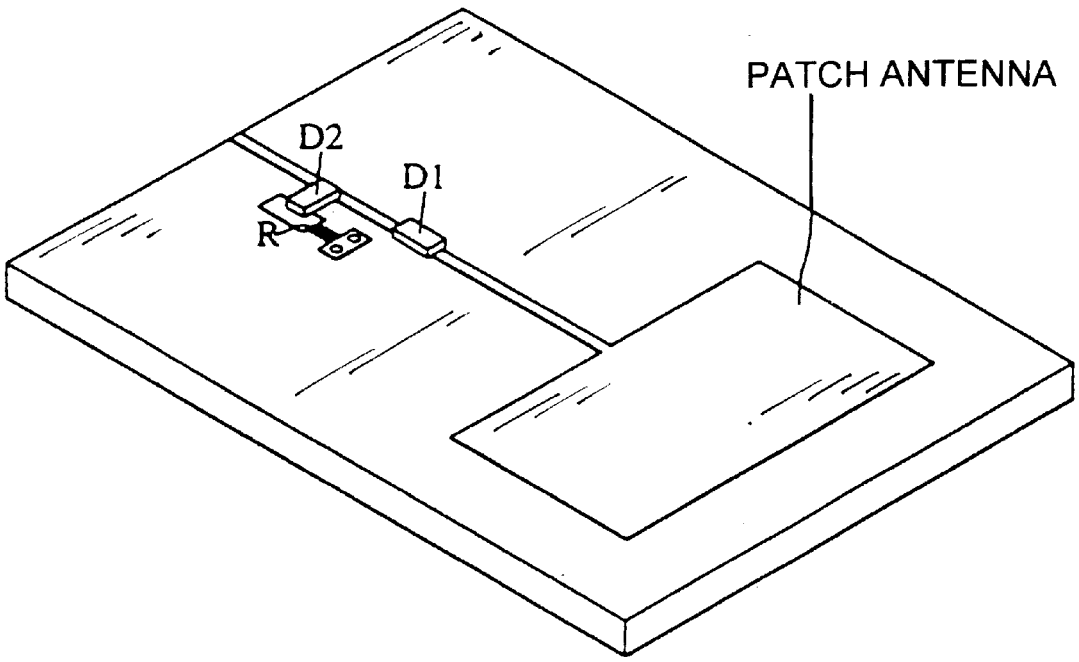
Figure 16:
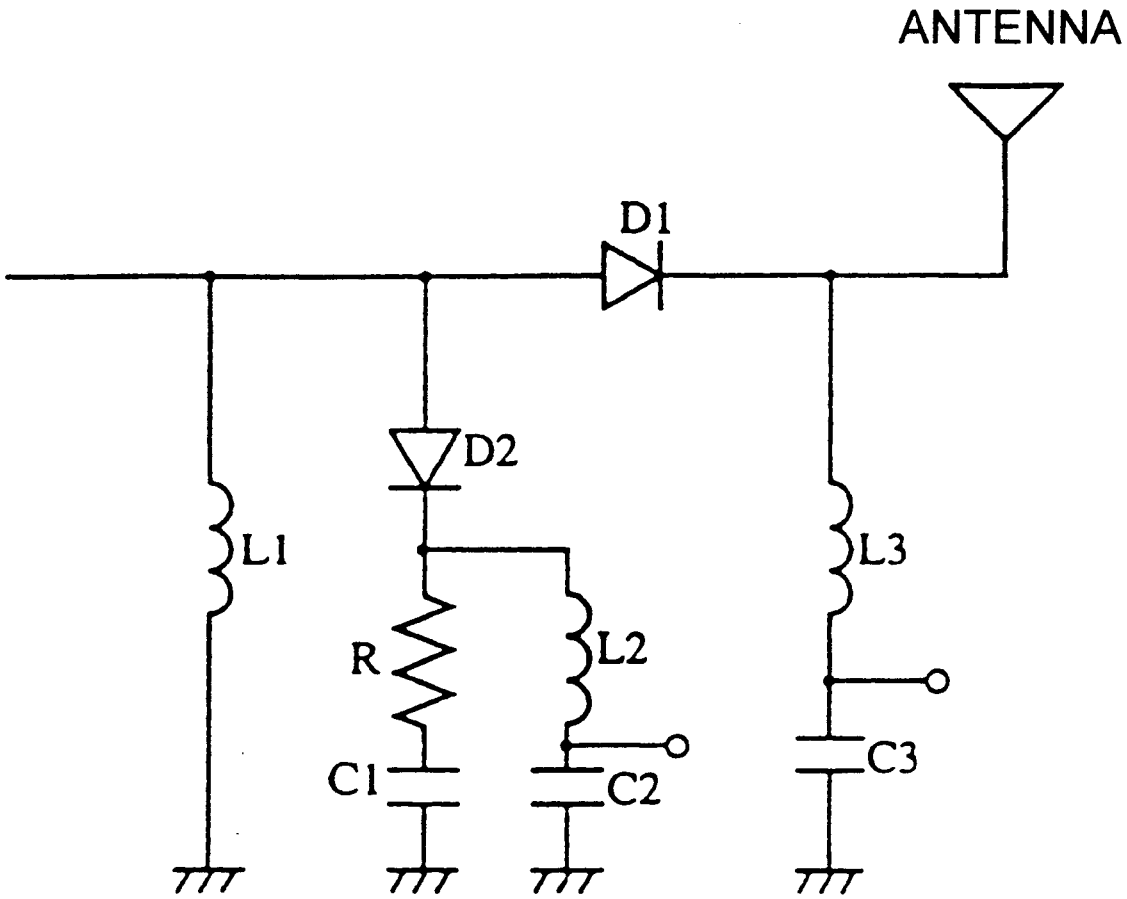
FIG. 16 is an equivalent circuit diagram showing the construction of a conventional radio-frequency radiation source.

Next, the construction of an antenna module is explained based on FIG. 13. In the figure, 30*a* through 30*d* represent radio-frequency radiation sources, respectively, and these constitute a radio-frequency radiation array like that of FIG. 11 or FIG. 12. A slot plate 8 is provided in the radiation direction of an electromagnetic wave of these radio-frequency radiation sources 30*a* through 30*d*, and in the slot plate 8 slots are formed in accordance with each of the radio-frequency radiation sources as shown in the previous embodiments. Further, a dielectric lens is arranged at a position in which each of the radio-frequency radiation sources of the radio-frequency radiation source array becomes a focusing surface.

As constructed this way, by causing any one of the resonators of the radio-frequency radiation sources 30*a* through 30*d* to go into a resonant state, beams Ba through Bd are formed in the direction determined by the positional relationship between the radio-frequency radiation source in a resonant state and the dielectric lens. Accordingly, for example, by selecting the radio-frequency radiation sources 30*a* through 30*d* in turn it becomes possible to scan with beams.

Figure 14:
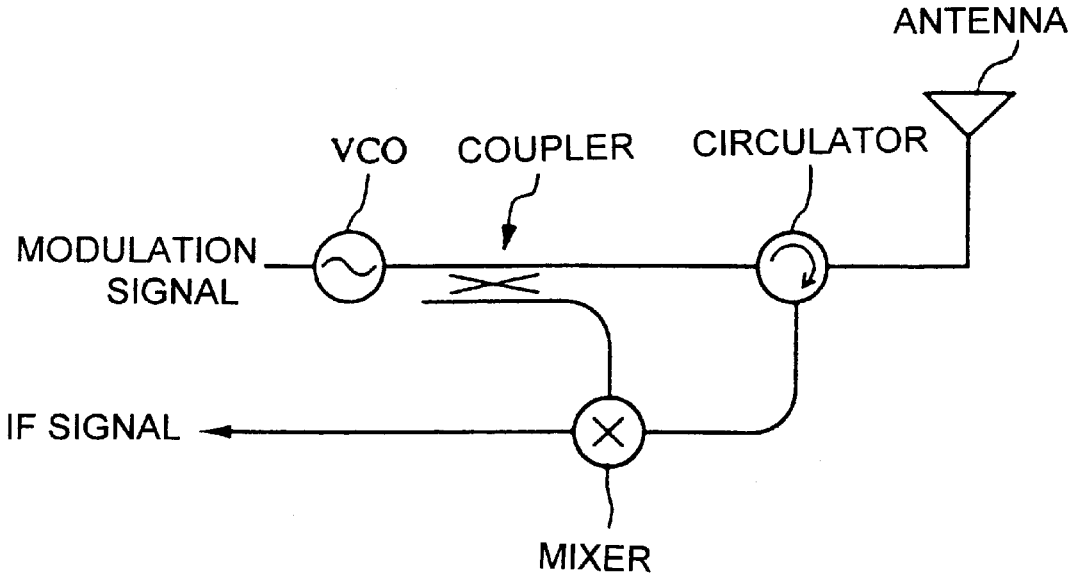
FIG. 14 is a block diagram showing the construction of a radio equipment.

Next, one example of the construction of a radio equipment is shown in FIG. 14. In the figure, VCO is an oscillator to change oscillation frequency by a modulation signal and the oscillation signal is radiated from an antenna through a circulator. When an electromagnetic wave reflected from an object to be detected enters the antenna, the reception signal is provided to a mixer through the circulator. On the other hand, part of a transmission signal is provided to the mixer as a local signal through a coupler. The mixer takes out the differential frequency component between the two signals and outputs it as an IF signal (intermediate frequency signal). In this way, a millimeter wave radar can be constructed using an FM-CM system. At that time, by using the antenna as an array antenna of a radio-frequency radiation source array shown in FIG. 13 as the antenna, a radar which is capable of beam-scanning can be obtained.

While the invention has been particularly shown and described with reference to preferred embodiments, it will be understood by those skilled in the art that the foregoing and other changes in form and details can be made without departing from the spirit and scope of the invention.

What is claimed is:

1. A radio-frequency radiation source comprising a resonator having at least one of a switching element and a variable reactance element and having a resonance frequency, the resonance frequency of the resonator switched by at least one of turn-on and turn-off of the switching element and by a change of reactance of the variable reactance element, a radiator to radiate to the outside an electromagnetic energy of a fixed frequency stored in the resonator, and a transmission line coupled to the resonator; further wherein the resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

2. The radio-frequency radiation source of claim 1, wherein a dielectric resonator is provided in the electrodeless part on the dielectric plate.

3. The radio-frequency radiation source of claim 1, further comprising a secondary transmission line coupled to the resonator, and wherein at least one of the switching element and the variable reactance element is connected to the secondary transmission line.

4. A radio-frequency radiation source array, comprising a plurality of radio-frequency radiation sources, each radio-frequency radiation source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator and wherein one end of each transmission line of the radio-frequency radiation sources is connected in parallel with each other; further wherein each resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

5. The radio-frequency radiation source array of claim 4, further wherein a dielectric resonator is provided in the electrodeless part on the dielectric plate.

6. The radio-frequency radiation source array of claim 4 further comprising a secondary transmission line coupled to each resonator and wherein at least one of the switching element and the variable reactance element is connected to the secondary transmission line.

7. A radio-frequency radiation source array, comprising a plurality of radio-frequency radiation sources, each source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator and wherein each transmission line of the radio-frequency radiation sources is connected in series and one end portion of the transmission lines connected in series is terminated; further wherein each resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

8. The radio-frequency radiation source array of claim 7, further wherein a dielectric resonator is provided in the electrodeless part on the dielectric plate.

9. The radio-frequency radiation source array of claim 7, further comprising a secondary transmission line coupled to each resonator, and wherein at least one of the switching element and the variable reactance element is connected to the secondary transmission line.

10. An antenna module comprising a radio-frequency radiation source array, the array comprising a plurality of radio-frequency radiation sources, each radio-frequency radiation source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator and wherein one end of each transmission line of the radio-frequency radiation sources is connected in parallel with each other and further comprising a dielectric lens wherein a location of each of the radio-frequency radiation sources of the radio-frequency radiation source array becomes nearly a focusing surface.

11. The antenna module of claim 10 wherein each resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

12. The antenna module of claim 11, wherein a dielectric resonator is provided in the electrodeless part on the dielectric plate.

13. The antenna module of claim 10, further comprising a secondary transmission line coupled to each resonator, and wherein at least one of the switching element and the variable reactance element is connected to the secondary transmission line.

14. An antenna module comprising a radio frequency radiation source array, the array comprising a plurality of radio-frequency radiation sources, each source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator and wherein each transmission line of the radio-frequency radiation sources is connected in series and one end portion of the transmission lines connected in series is terminated and further comprising a dielectric lens wherein a location of each of the radio-frequency radiation sources of the radio-frequency radiation source array becomes nearly a focusing surface.

15. The antenna module of claim 14, wherein each resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

16. The antenna module of claim 15, wherein, a dielectric resonator is provided in the electrodeless part on the dielectric plate.

17. The antenna module of claim 14, further comprising a secondary transmission line coupled to each resonator, and wherein at least one of the switching element and the variable reactance element is connected to the secondary transmission line.

18. Radio equipment comprising a radio-frequency radiation source, the radio-frequency radiation source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator, further comprising a radio-frequency radiation source array, the radio frequency radiation source array comprising a plurality of said radio frequency radiation sources, and wherein one end of each transmission line of the radio-frequency radiation sources is connected in parallel with each other, and further comprising one of a transmission circuit and a reception circuit connected to the transmission line; further wherein the resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

19. The radio equipment of claim 18, wherein a dielectric resonator is provided in the electrodeless part on the dielectric plate.

20. The radio equipment of claim 18, further comprising a secondary transmission line coupled to the resonator, and wherein at least one of the switching element and the variable reactance element is connected to the secondary transmission line.

21. Radio equipment comprising a radio-frequency radiation source, the radio-frequency radiation source comprising a resonator having at least one of a switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator, further comprising a radio-frequency radiation source array, the radio frequency radiation source array comprising a plurality of said radio frequency radiation sources, and wherein each transmission line of the radio-frequency radiation sources is connected in series and one end portion of the transmission lines connected in series is terminated, and further comprising one of a transmission circuit and a reception circuit connected to the transmission line; further wherein the resonator comprises electrodes having opposing electrodeless parts formed on both sides of a dielectric plate, wherein a section of the electrodeless part on at least one side of the dielectric plate comprises a slit, and wherein at least one of the switching element and the variable reactance element is provided across the slit.

22. The radio equipment of claim 21, wherein a dielectric resonator is provided in the electrodeless part on the dielectric plate.

23. The radio equipment of claim 21, further comprising a secondary transmission line coupled to the resonator and wherein at least one of the switching element and the variable reactance element is connected to the secondary transmission line.

24. Radio equipment comprising a radio-frequency radiation source, the radio frequency radiation source comprising a resonator having at least one of a switching element and a variable reactance element and having a resonance frequency, the resonance frequency of the resonator switched by at least one of turn on and turn-off of the switching element and by a change of the reactance of the variable reactance element, a radiator to radiate to the outside an electromagnetic energy of a fixed frequency stored in the resonator, and a transmission line coupled to the resonator, further comprising an antenna module comprising a radio frequency radiation source array, the array comprising a plurality of said radio frequency radiation sources and wherein one end of each transmission line of the radio frequency radiation sources is connected in parallel with each other and further comprising a dielectric lens wherein a location of each of the radio-frequency radiation sources of the radio-frequency radiation source array becomes nearly a focusing surface, and further comprising one of a transmission circuit and a reception circuit connected to the transmission line.

25. The radio equipment of claim 24, wherein the resonator comprises electrodes having opposing electrodeless parts formed on both sides of the dielectric plate, wherein a section of the electrodeless part on at least one side of the dielectric plate comprises a slit, and wherein at least one of the switching element and the variable reactance element is provided across the slit.

26. The radio equipment of claim 25, wherein a dielectric resonator is provided in the electrodeless part of the dielectric plate.

27. The radio equipment of claim 24, further comprising a secondary transmission line coupled to the resonator and wherein at least one of the switching element and the variable reactance element is connected to the secondary transmission line.

28. Radio equipment comprising a radio-frequency radiation source, the radio-frequency radiation source comprising a resonator having at least one of switching element and a variable reactance element and having a resonance frequency, the resonance frequency of the resonator switched by at least one of turn-on and turn-off of the switching element and by a change of a reactance of the variable reactance element, a radiator to radiate to the outside an electromagnetic energy of a fixed frequency stored in the resonator, and a transmission line coupled to the resonator, further comprising an antenna module comprising a radio frequency radiation source array, the array comprising a plurality of said radio frequency radiation sources, wherein each transmission line of the radio frequency radiation sources is connected in series and one end portion of the transmission lines connected in series is terminated and further comprising a dielectric lens wherein a location of each of the radio frequency radiation sources of the radio frequency radiation source array becomes nearly a focusing surface and further comprising one of a transmission circuit and a reception circuit connected to the transmission line.

29. The radio equipment of claim 28, wherein the resonator comprises electrodes having opposing electrodeless parts formed on both sides of the dielectric plate, wherein a section of the electrodeless part on at least one side of the dielectric plate comprises a slit, and wherein at least one of the switching element and the variable reactance element is provided across the slit.

30. The radio equipment of claim 29, wherein a dielectric resonator is provided in the electrodeless part of the dielectric plate.

31. The radio equipment of claim 28, further comprising a secondary transmission line coupled to the resonator and wherein at least one of the switching element and the variable reactance element is connected to the secondary transmission line.

* * * * *